US005653820A

United States Patent [19]

Higashino

[11] Patent Number: 5,653,820

[45] Date of Patent: Aug. 5, 1997

[54] METHOD FOR CLEANING METAL ARTICLES AND REMOVING WATER FROM METAL ARTICLES

[75] Inventor: Morio Higashino, Nagano, Japan

[73] Assignee: Minebea Co. Ltd., Japan

[21] Appl. No.: 608,202

[22] Filed: Feb. 28, 1996

Related U.S. Application Data

[63] Continuation of Ser. No. 355,807, Dec. 14, 1994, abandoned, which is a continuation of Ser. No. 137,784, Oct. 19, 1993, abandoned, which is a division of Ser. No. 17,397, Feb. 12, 1993, Pat. No. 5,333,629.

[30] Foreign Application Priority Data

Mar. 10, 1992 [JP] Japan ..... 4-086195

[51] Int. Cl.[6] ..... B08B 3/00; B08B 7/04

[52] U.S. Cl. ..... 134/29; 134/30; 134/31; 134/37; 34/517

[58] Field of Search ..... 134/2, 21, 29, 134/30, 37, 31; 34/516, 517, 410, 411, 413

[56] References Cited

U.S. PATENT DOCUMENTS

| | | | |
|---|---|---|---|
| 3,024,139 | 3/1962 | Shoemaker | 134/29 X |
| 3,297,481 | 1/1967 | Newman | 134/30 X |
| 4,314,856 | 2/1982 | Steimel | 134/29 X |
| 4,871,417 | 10/1989 | Nishizawa et al. | 134/21 |
| 4,931,102 | 6/1990 | Burke | 134/29 X |
| 4,931,104 | 6/1990 | Burke | 134/21 X |
| 5,105,556 | 4/1992 | Kurokawa et al. | 34/12 |
| 5,180,438 | 1/1993 | Hockh et al. | 134/21 |
| 5,263,264 | 11/1993 | Usui et al. | 134/21 X |

*Primary Examiner*—Jill Warden
*Assistant Examiner*—Saeed Chaudhry
*Attorney, Agent, or Firm*—Nixon & Vanderhye

[57] ABSTRACT

A method of cleaning metal articles comprises the steps of cleaning metal articles with alkaline washing water, rinsing the metal articles with deoxidized rinsing water, removing water from the metal articles by blowing dry vapor on the metal articles and drying the same in a heated atmosphere. Further, an apparatus for cleaning metal articles comprises a washing reservoir for containing alkaline washing water, a rinsing water deoxidizing device, a rinsing reservoir connected to the water-deoxidizing device, for containing deoxidized rinsing water supplied from the rinsing water deoxidizing device, a boiler, a water-removing reservoir connected to the boiler and supplied with dry vapor from the boiler, and a drying reservoir having an interior in which a heated atmosphere is created, which reservoirs are arranged in this order. Still further, an apparatus for rinsing metal articles comprises a rinsing water deoxidizing device for producing deoxidized rinsing water, and a rinsing reservoir connected to the rinsing water deoxidizing device and supplied therefrom with the deoxidized rinsing water for rinsing the metal articles in the rinsing reservoir. More further, an apparatus-for removing water from metal articles comprises a water-removing reservoir and a boiler for producing dry vapor and supplying the dry vapor to the water-removing reservoir.

4 Claims, 2 Drawing Sheets

A
1
2
3
4
5
6
7
7a
7b
7c
8
8a
8b
9
9a
10
11
11a
11b
12
13
14
15
15a
17
17a
18
19
19a
20
21
21a
21b
22
23
24
25
26
27
27a
28
29
30
30a
31
31a
32
33
34
34a
35
35a
36
37
37a
38
39
41
41a
42
43
44
45
47
57
58
59
71
72
73
74
75
80

METHOD FOR CLEANING METAL ARTICLES AND REMOVING WATER FROM METAL ARTICLES

This is a file wrapper continuation of application Ser. No. 08/355,807, filed Dec. 14, 1994, now abandoned which is a continuation of 08/137,784, filed Oct. 10, 1993 now abandoned which is a division of 08/017,397 filed Feb. 12, 1993, now U.S. Pat. No. 5,333,629.

BACKGROUND OF THE INVENTION

1. Field of the Invention

This invention relates to a method and an apparatus for cleaning metal articles, an apparatus for rinsing metal articles and an apparatus for removing water from metal articles.

2. Description of the Related Art

Since an easily corrosive metal such as bearing steel begins to rust as soon as it is soaked in water, it has hitherto been extremely difficult to clean parts, semi-assemblies or products made of such metal (hereinafter referred to as "metal articles"), particularly precision metal articles including bearings.

Conventionally, metal articles have been washed in alkaline washing water and then rinsed in rinsing water to which a rust inhibiter had been added so that they do not rust. Thereafter, they have been dried by an air knife or a hot-air dryer.

Using this conventional method, however, there is a problem in that a residue of a rust inhibiter remains on the surfaces of metal articles. When rinsing water is disposed of as waste water, this requires that a waste-water treatment device be provided, thereby increasing the cost of cleaning the metal articles. Further, after removal of rinsing water from the surfaces-of the metal articles, stains are likely to remain on their surfaces, due to use of the rinsing water containing the rust inhibiter.

Fluorocarbon or 1, 1, 1-trichloroethane has been used to improve the drying quality of the metal articles after removal of the rinsing water. However, both materials destroy the ozone layer, causing natural environmental disruption. In addition, the latter material is apt to damage the operator's health.

There has been further developed means for rinsing metal articles in deoxidized rinsing water. Using this means, however, the appearance of stains and small rust spots could not be prevented, because the conventional rinsing-water removing method and drying method were used.

SUMMARY OF THE INVENTION

The object of this invention is to provide a method and an apparatus for cleaning metal articles, an apparatus for rinsing metal articles and an apparatus for drying metal articles, which clean metal articles, particularly precision metal articles safely as well as thoroughly and excellently at low cost, without using a costly water-wasting apparatus or either fluorocarbon which causes natural environmental disruption or 1, 1, 1-trichloroethane which is harmful to the natural environment and can adversely effect the operator's health. In order to achieve the object of this invention, a method for cleaning metal articles comprises the steps of washing metal articles in alkaline washing water, rinsing the metal articles in deoxidized rinsing water, blowing dry vapor on the metal articles to remove the rinsing water therefrom, and drying the metal articles in a heated atmosphere.

An apparatus for cleaning metal articles according to this invention comprises at least one washing reservoir containing alkaline washing water for washing metal articles in the washing reservoir, at least one deoxidizing device for producing deoxidized rinsing water, at least one rinsing reservoir containing the deoxidized rinsing water supplied from the deoxidizing device, the deoxidized rinsing water being adapted to rinse the metal articles in the rinsing reservoir, at least one boiler for producing dry vapor, at least one water-removing reservoir to which the dry vapor for removing water from the metal articles in the water-removing reservoir is supplied from the boiler, and at least one drying reservoir in which a heated atmosphere is maintained for drying the metal articles in the drying reservoir, and wherein the washing reservoir, the rinsing reservoir, the water-removing reservoir and the drying reservoir are arranged in this order.

A rinsing apparatus according to this invention comprises at least one rinsing water deoxidizing device for producing deoxidized rinsing water, and at least one rinsing reservoir connected to the rinsing water deoxidizing device and supplied with deoxidized rinsing water for rinsing said articles in the rinsing reservoir from the deoxidizing device.

An apparatus for removing water from metal articles according to this invention comprises at least one boiler for producing dry vapor, at least one water-removing reservoir which is connected to the boiler and to which the dry vapor for removing water from meal articles in the water-removing reservoir is supplied from the boiler. The dry vapor is jetted onto the metal articles and removes water from the surfaces thereof.

Metal articles are first placed in the washing reservoir and washed in alkaline water, so that oil components are removed from the surfaces of the metal articles. After being washed, the metal articles are transferred to the rinsing reservoir in which they are rinsed in deoxidized rinsing water in a deoxidized state. Thereafter, they are transferred to the water-removing reservoir in which dry vapor from the boiler is evenly jetted on the entire surfaces of the metal articles so that they are covered with the dry vapor in a deoxidized state and maintained at a high temperature suited for drying them. Finally, the metal articles are transferred to the drying reservoir and dried both quickly and thoroughly so as to be free from stains and rust spots.

BRIEF DESCRIPTION OF THE DRAWINGS

This invention will be fully understood from the following detailed description by way of the preferred embodiments with reference to the accompanying drawings in which.

DESCRIPTION OF THE PREFERRED EMBODIMENTS

Figure 1:
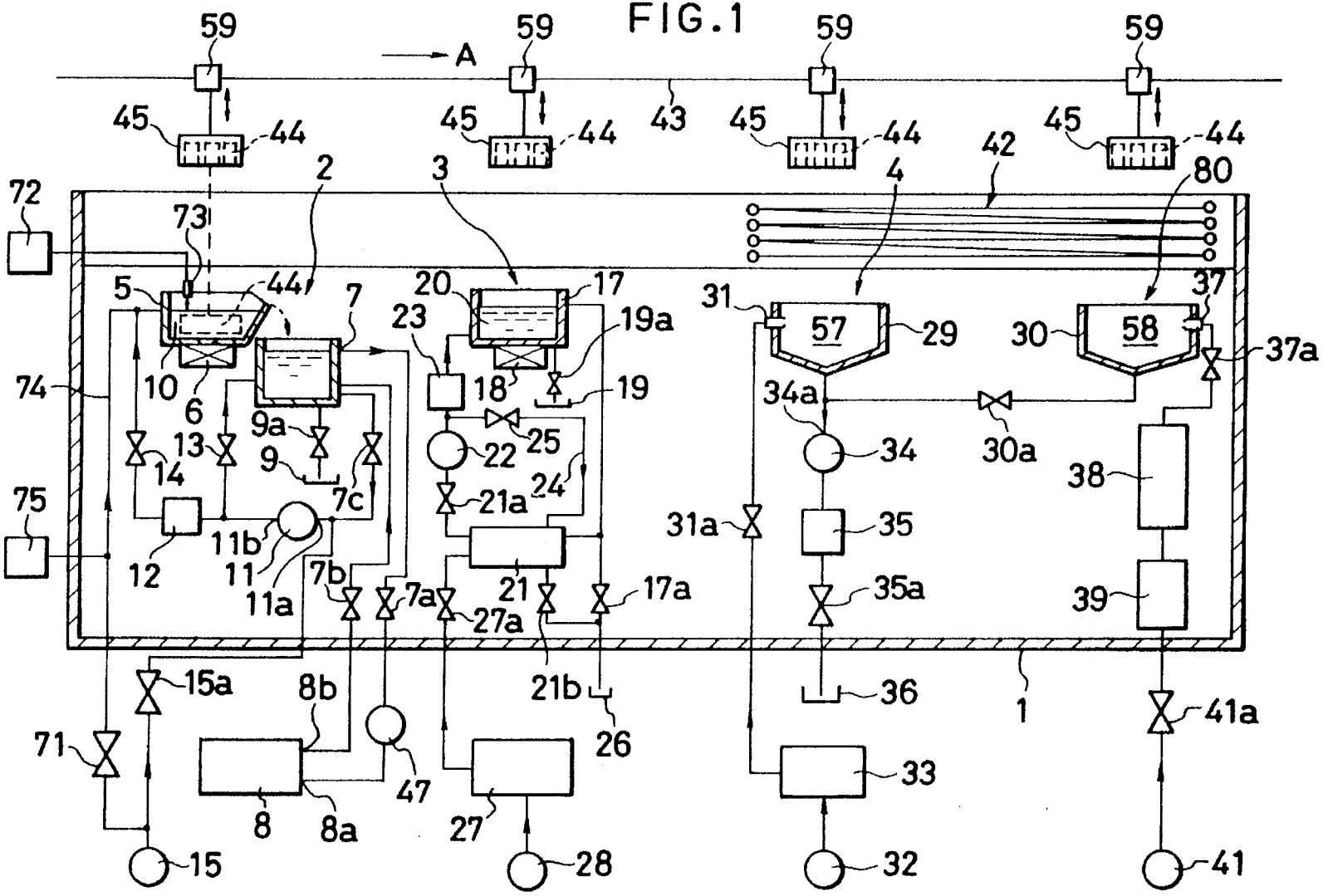
FIG. 1 is a general longitudinal cross-sectional view of an embodiment of this invention.

As shown in FIG. 1, a cleaning apparatus of the first embodiment according to this invention comprises a washing section 2, a rinsing section 3, a water-removing section 4 and drying section 80, all mounted In a frame 1. When used separately, the rinsing section 3 constitutes an apparatus for rinsing metal articles and the water-removing section 4 constitutes an apparatus for removing water from metal articles.

The washing section 2 includes a washing reservoir 5 filled with alkaline washing water 10 (such as water including a surface active agent) for washing metal articles (such as components of bearings, their semi-assemblies and their assemblies) made of a metal such as bearing steel or any other corrosive metal. On the washing reservoir 5 is provided an ultrasonic generator 6 for vibrating the washing water 10 in the washing reservoir 5.

A washing water tank 7 is provided adjacent to the washing reservoir 5, the water level of the tank 7 being maintained lower than that of the reservoir 5, whereby the tank 7 receives the water overflowing from the reservoir 5. The washing water tank 7 is connected to a drain 9 through a throttle valve 9*a* in order to maintain the water level of the washing water in the tank 7 and exhaust waste washing water to be disposed of therethrough.

A water-oil separator 8 for separating, from the washing water 10, oil components such as dissolved machine oil from the metal articles has an inlet port 8*a* connected to an upper portion of the washing water tank 7 through a pump 47 and a throttle valve 7*a*, and an outlet port 8*b* connected to a lower portion of the washing tank 7 through a throttle valve 7*b*.

A washing pump 11 has an inlet port 11*a* which is connected to a lower portion of the tank 7 through a throttle valve 7*c* and an outlet port 11*b* which is connected to an intermediate portion of the tank 7 through a throttle valve 13 on the one hand, and to the washing reservoir 5 through a filter 12 and a throttle valve 14, on the other hand. The washing pump 11 is designed to circulate the washing water 10 in a fluid circuit comprising the washing reservoir 5, the washing water tank 7, the washing pump 11, the filter 12 and the valves 7*c* and 14, and supplies the washing water to the washing reservoir 5 and the washing water tank 7 at a predetermined ratio through throttle valves 13 and 14 so as to maintain the water's concentration, its flow rate and its degree of purification at predetermined values. The inlet port 11*a* of the washing pump 11 is connected to a water source 15 through a throttle valve 15*a* so that water is supplied from the water source 15 to the pump 11.

The water source 15 is also connected to an upper portion of the washing reservoir 5 by means of a washing-water supplying pipe 74 via a manually operated throttle valve 71. A water-level sensor 73 of any type is provided in the reservoir 5 for checking whether the washing water 10 is at the predetermined level or not in the reservoir 5. Electrically connected to the sensor 73 is an warning device 72 such as a warning lamp or a warning buzzer which indicates that the level of the washing water 10 is lower than the predetermined level. An alkaline washing agent supplier 75 is connected to the washing-water supplying pipe 74.

When the sensor 73 detects that the washing water 10 is lower than the predetermined level, the device 72 generates a warning sign. The operator opens the valve 71 to allow washing water to be supplied from the water source 15 to the washing reservoir 5 through the valve 71. In this process, an alkaline agent is added to the washing water in the pipe 74 from the alkaline washing agent supplier 75 so that the concentration of the washing water is maintained. When the upper surface of the washing water reaches the predetermined level, the sensor 73 detects this and the signal therefrom ceases the generation of the warning sign. The operator closes the valve 71 so that the supply of water from the water source 15 to the washing reservoir 5 through the valve 72 is terminated.

The rinsing section 3 includes a rinsing reservoir 17 filled with deoxidized rinsing water 20 and is provided with an ultrasonic generator 18 having the same structure as the ultrasonic generator 6 for vibrating the washing water 10 in the washing reservoir 5. The vibrator 18 oscillates the deoxidized rinsing water 20 in the rinsing reservoir 17. The bottom portion of the rinsing reservoir 17 is connected to a drain 19*a* through a throttle valve 19*a* in order that the deoxidized rinsing water 20 can be drained from its interior. In place of the ultrasonic generators 6 and 18, any other types of vibrators or vibration generators can be used for vibrating the washing water and the deoxidized rinsing water.

A deoxidized rinsing water tank 21 is connected to the rinsing reservoir 17 via a throttle valve 21*a*, a pump 22 and a filter 23 so that deoxidized rinsing water 20 is supplied by the pump 22 from the deoxidized rinsing water tank 21 to the rinsing reservoir 17. The deoxidized rinsing water tank 21 has a water circulating circuit 24 branched from the pump 22, for returning the deoxidized rinsing water 20 to the deoxidized rinsing water tank 21 itself. The ratio of the amount of deoxidized rinsing water supplied from the deoxidized rinsing water tank 21 to the rinsing reservoir 17, to the amount of deoxidized rinsing water 20 returned from the rinsing reservoir 17 to the deoxidized rinsing water tank 21 is determined by a throttle valve 25.

A drain 26 is connected through a throttle valve 17*a* to the rinsing reservoir 17 at the uppermost water level thereof. As deoxidized rinsing water is supplied from the later-described water-deoxidizing device 27 to the rinsing reservoir 17 through the deoxidized rinsing water tank 21, so-called old deoxidized rinsing water overflows from the rinsing reservoir 17 and is drained to the drain 26 through the valve 17*a*. As a result, the rinsing reservoir 17 is always kept supplied and filled with fresh deoxidized rinsing water which contains little oxygen residue, thereby preventing rust spots from forming on the metal articles during the rinsing process.

The drain 28 is also connected to the upper portion of the deoxidized rinsing water tank 21 via the throttle valve 17*a* so that the deoxidized rinsing water overflows from the deoxidized rinsing water tank 21 and is exhausted therefrom, on the one hand, and the drain 26 is further connected to the bottom of the deoxidized rinsing water tank 21 via a throttle valve 21*b* so that water is drained from the tank 21 when the tank 21 is cleaned, on the other hand.

Connected to the deoxidized rinsing water tank 21 through a throttle valve 27*a* is a rinsing water deoxidizing device 27 which produces deoxidized rinsing water and supplies the same to the tank 21, and to which water is supplied from a water source 28. Since a metal—even if it is a very corrosive type such as bearing steel—does not easily rust in deoxidized rinsing water when the residual oxygen concentration is 50 PPB (preferably 20 PPB) or less, a rinsing water deoxidizing device 27 for producing deoxidized rinsing water in this range of residual oxygen concentration (i.e., 50 PPB (preferably 20 PPB) or less) is used.

The water-removing section 4 includes a water-removing reservoir 29.

The water-removing reservoir 29 has nozzles 31 for jetting dry vapor onto metal articles in the reservoir 29. Only one nozzle 31 is shown in FIG. 1 for simplicity, but in fact a plurality of nozzles 31 are arranged equidistantly, vertically and circumferentially in the water-removing reservoir 29 so that dry vapor is jetted into the interior 57 and evenly onto the metal articles in the water-removing reservoir 29.

The nozzles 31 are connected through a throttle valve 31*a* to a boiler 33 to which water is supplied from a water source 32. Dry vapor at a high temperature is supplied from the boiler 33 to the nozzles 31 and jetted into the interior 57 of the water-removing reservoir 29. Since the dry vapor does not contain any liquid phase and is at a high temperature, this ensures that water is easily removed from the metal articles in the water-removing reservoir 29, without the need to use either fluorocarbon or 1, 1, 1-trichloroethane, which can damage the natural environment as well as the operator's health. Further, jetting of dry vapor evenly onto metal articles facilitates even removal of water from the metal articles in a non-oxygen state, preventing formation of rust on their surfaces. Moreover, use of dry vapor prevents stains from forming on the surfaces of the metal articles, as a result of which no pure-water producing device is required, thereby reducing the cleaning cost.

A drain 36 is connected to the bottom portion of the water-removing reservoir 29 via an exhaust fan 34, a throttle valve 35*a* and a condenser 35 for changing vapor exhausted from the water-removing reservoir 29 into water, and the water thus changed is disposed of to the drain 36.

The drying section 80 includes a drying reservoir 30 and a plurality of nozzles 37 arranged equidistantly, vertically and circumferentially in the reservoir 30, although only one of them is shown in FIG. 1 for simplicity. The nozzles 37 are connected to a compressed gas source 41 for supplying compressed inert gas such as compressed nitrogen gas or compressed air via a heater 38 such as an electric heater, a filter 39 and throttle valves 37*a* and 41*a*. The compressed gas from the compressed gas source 41 is filtered by the filter 39 and is heated by the heater 38 to a predetermined temperature. Thereafter, the heated compressed gas is jetted from the nozzles 37 onto the metal articles in the interior 58 of the drying reservoir 30 and dries the metal articles evenly. The bottom of the drying reservoir 30 is also connected to the inlet port 34*a* of the exhaust fan 34 via a throttle valve 30*a*. Inert gas such as nitrogen gas can be used as heated compressed gas for drying corrosive metal articles which are susceptible to rusting on the one hand, and heated compressed air as compressed gas for drying metal articles which are less susceptible to rusting, on the other hand.

A condensing coil 42 surrounds the area directly above the water-removing section 4 and the drying section 80, i.e., the water-removing reservoir 29 and the drying reservoir 30 so that the condensing coil 42 condenses, into water, vapor rising from the water-removing reservoir 29 and the drying reservoir 30.

An endless horizontal conveyer 43 moved in the direction A in FIG. 1 by conventional driving means is provided directly above the reservoirs 5, 17, 29 and 30. The reservoirs 5, 17, 29 and 30 are arranged equidistantly along the conveyer 43 in this order. Cleaning cages 45 which are moved up and down by lifting means 59 and contain metal articles 44 are arranged so that they are located at the same time at the positions directly above the reservoirs 5, 17, 29 and 30, respectively. The conveyer 43 moves the cleaning cages 45 in the direction A intermittently by the driving means, as described below.

The operation of the first embodiment will now be explained. First, the pumps 11 and 22, the exhaust fan 34 and the ultrasonic generators 6 and 18 are actuated to set the cleaning apparatus in an operating condition. Next, a cleaning cage 45, which contains metal articles 44 such as bearing assemblies constituting precision metal articles, (the cleaning cage being hereinafter referred to as the "first cage 45") is positioned directly above the washing reservoir 5.

From this position, all of the cleaning cages 45 are lowered into their corresponding reservoirs. In the washing reservoir 5, the metal articles 44 are soaked in the alkaline washing water 10 and oil components such as machine oil are removed from the surfaces of the metal articles 44. The washing water 10 is vibrated by the ultrasonic generator 6, enhancing the oil-component removing efficiency. The washing water 10 is supplied from the washing water tank 7 to the washing reservoir 5 by the pump 11.

The washing water 10 dissolves oil components from the metal articles 44 and overflows from the washing water tank 7, and part thereof is supplied by the pump 47 from the washing water tank 7 to the water-oil separator 8. After the oil components have been removed from the washing water 10 in the oil-water separator 8, the washing water 10 is returned to the washing water tank 7. When the amount of washing water 10 in the washing reservoir 5 falls, the throttle valve 71 is opened by the operator to supply washing water 10 from the water source 15 to the washing reservoir 5, as already mentioned.

After the washing process, all of the cleaning cages 45 are raised by the lifting means 65 and are moved in the direction A along a length corresponding to a distance between adjacent cleaning cages 45, and then they are lowered again. The first washing cage 45 is now situated in the rinsing reservoir 17 and soaked in deoxidized rinsing water, whereby the metal articles 44 are rinsed in a deoxidized state.

Since deoxidized rinsing water is constantly supplied from the deoxidized rinsing water tank 21 to the rinsing reservoir 17 and disposed of through the upper portion of the rinsing reservoir 17 to the drain 26, the rinsing water is maintained in a deoxidized state, thus eliminating the requirement for a rust inhibiter to be provided.

At the time of rinsing, the cleaning cage 45 disposed at the directly left side of the first cleaning cage 45 in FIG. 1 (the cleaning cage 45 being hereinafter referred to as the "second cleaning cage 45") is placed in the washing reservoir 5 and metal articles 44 in the second cleaning cage 45 are washed. After having completed the washing and rinsing, all of the cleaning cages 45 are raised. Then, they are transferred in the direction A along a length corresponding to the distance between adjacent reservoirs, and are lowered again.

At this stage, the first cleaning cage 45 is now situated in the water-removing reservoir 29. Dry vapor supplied from the boiler 33 is jetted from the nozzles 31 onto the metal articles 44 in the first washing cage 45. As described above, water is constantly removed from the metal articles 44 in a deoxidized state, and thus rusting does not occur even if a solvent such as fluorocarbon or 1, 1, 1-trichloroethane is not used.

In this condition, the metal articles 44 in the first cage 45 are heated to a temperature which facilitates drying them. Because dry vapor is blown on the surfaces of the metal articles 44, their surfaces have an excellent finish with no stains or spots formed thereon. During the water removal process, the second and third cleaning cages 45 (the third cleaning cage being the one disposed at the directly left side of the second cleaning cage 45 in FIG. 1) are placed in the rinsing reservoir 17 and the washing reservoir 5, respectively. The metal articles 44 in them are rinsed and washed, respectively. Thereafter, all of the cleaning cages 45 are raised, moved in the direction A along a length corresponding to the distance between adjacent reservoirs and then lowered again.

The first cleaning cage 45 is now situated in the drying reservoir 30. Compressed gas supplied from the compressed gas source 41 and heated to a drying temperature by the heater 38 is jetted onto the metal articles 44 to dry them. During the drying process, the second to fourth cleaning cages 45 (the fourth cleaning cage being the one disposed at the directly left side of the third cleaning cage 45 in FIG. 1) are placed in the water-removing reservoir 29, the rinsing reservoir 17 and the washing reservoir 5, respectively.

Thus, the water removal, rinsing and washing of the metal articles 44 in the second to fourth cages, respectively, are performed simultaneously. Thereafter, all of the cleaning cages 45 are raised, moved in the direction A along a length corresponding to the distance between adjacent reservoirs, and then lowered.

As a result, the first cleaning cage 45 is now displaced rightward from the drying reservoir 30. In this process, the metal articles 44 in the second cleaning cage 45 are dried in the drying reservoir 30; water is removed, in the water-removing reservoir 29, from the metal articles 44 in the third cleaning cage 45; the metal articles 44 in the fourth cleaning cage 45 are rinsed in the main rinsing reservoir 17; and the metal articles 44 in the fifth cleaning cage 45, which is disposed at the directly left side of the fourth cleaning caged 45 in FIG. 1 are washed in the washing reservoir 5, all being carried out at the same time.

After this process, the step of washing of metal articles 44 in a new cleaning cage 45 and the steps of rinsing of the metal articles 44, removal of water from the metal articles 44 and drying of the metal articles 44 in other three cages 45 continue to be carried out simultaneously, as a result of which the metal articles 44 in all cleaning cages 45 are successively cleaned thoroughly and efficiently.

Figure 2:
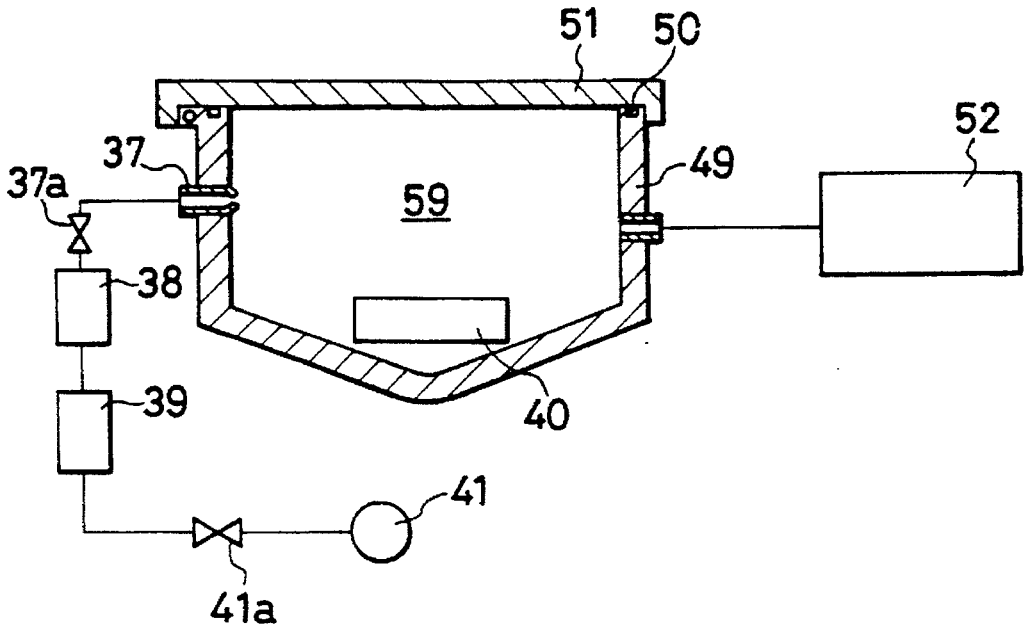
FIG. 2 is a longitudinal cross-sectional view of another embodiment of a drying reservoir according to this invention.

In FIG. 2 is shown the second embodiment of a drying reservoir comprising a vacuum reservoir 49, the interior 59 of which is fluid-tightly sealed by means of a cover 51 via an O-ring 50. When the cover 51 is opened, metal articles are placed in the vacuum reservoir 49. A compressed gas source 41 containing compressed gas comprising compressed air or compressed inert gas such as compressed nitrogen gas is connected to the interior 59 of the vacuum reservoir 49 via a nozzle 37 or nozzles 37 arranged equidistantly, vertically and circumferentially in the circumferential wall of the reservoir 49, a heater 38 such as an electric heater and a filter 39, similar to the case of the first embodiment shown in FIG. 1.

After the cover 51 has been completely closed in a fluid-tight state, the interior 59 of the vacuum reservoir 49 is evacuated by an evacuating device 52 connected thereto and is heated by a heater 40 such as an electric heater to create a heated atmosphere within the interior 59, thereby to prevent the surfaces of the metal articles from becoming cold. The compressed gas supplied from the compressed gas source 41 through the filter 39 is heated by the heater 38 to a predetermined temperature and then is introduced into the heated atmosphere formed in the interior 59 of the vacuum reservoir 49. The heated compressed gas in the atmosphere dries the metal articles in the vacuum reservoir 49, thereby to ensure that a excellent rust-proof finish is obtained similarly to the case in FIG. 1.

Figure 3:
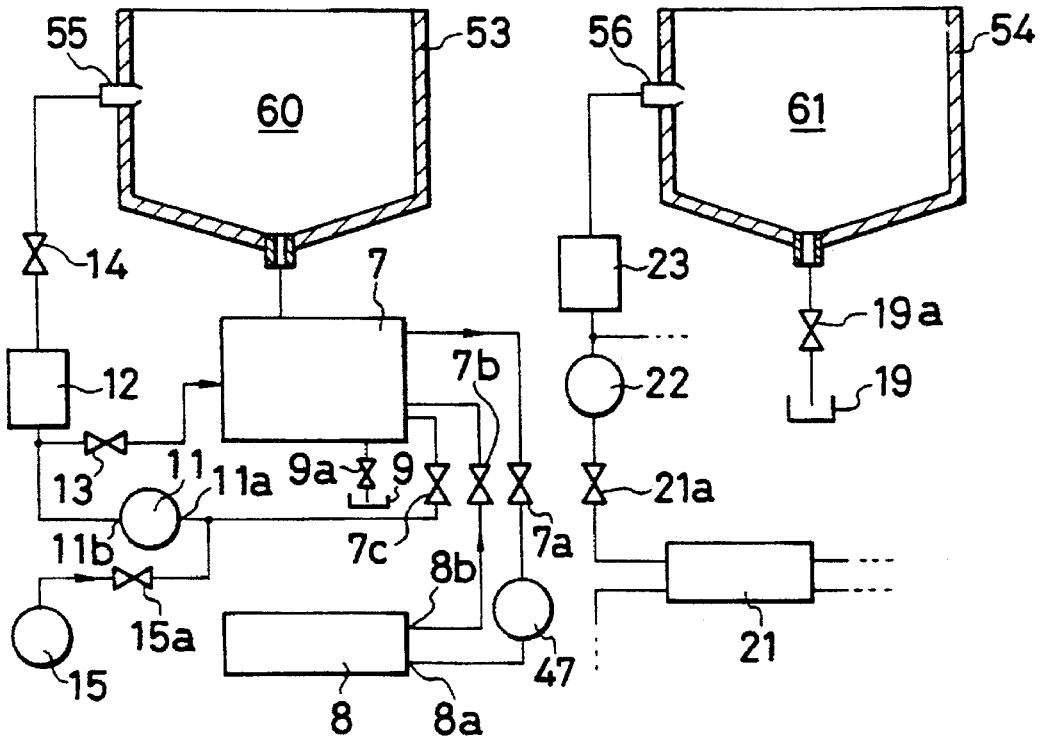
FIG. 3 is a longitudinal cross-sectional view of another embodiment of a combination of a washing reservoir and a rinsing reservoir according to this invention.

Shown in FIG. 3 is another embodiment of a combination of a washing reservoir 53 and a rinsing reservoir 54. These reservoirs 53 and 54 are respectively provided with a plurality of nozzles 55 (only one shown for simplicity) for jetting washing water into the interior 60 of the reservoir 53 and nozzles 56 (only one shown for simplicity) for jetting deoxidized rinsing water in the interior 61 of the reservoir 54. The nozzles 55 and 58 are arranged equidistantly, vertically and circumferentially in the circumferential walls of the respective reservoirs 53 and 54 so that they spray washing water and deoxidized rinsing water evenly on the metal articles in the reservoirs 53 and 54, respectively. The remaining structure of the washing section and the rinsing section is the same as that of the first embodiment shown in FIG. 1.

Spraying washing water and deoxidized rinsing water evenly on metal articles in the washing reservoir 53 and the rinsing reservoir 54, respectively, ensures that metal articles are cleaned and dried without leaving any stains and spots on the surfaces of the metal articles.

During cleaning as performed by the cleaning apparatus shown in FIG. 1, the ultrasonic generators impart physical oscillatory energy to washing water and deoxidized rinsing water. When, therefore, semi-assembled metal articles are cleaned, the components of each metal article may come into contact with each other or be displaced relative to each other. However, spraying washing water and deoxidized rinsing water evenly on the metal articles by using the embodiment of FIG. 3 prevents the components of each metal article from coming into contact with or being displaced relative to each other.

For a mass-production purpose, a plurality of cleaning systems each comprising a washing section, a rinsing section and a drying section as described above may be provided in parallel with one after another. Above each cleaning system may be provided a conveyor which carries cleaning cages, as described above.

What is claimed is:

1. A method of cleaning metal articles comprising the steps of:

(1) cleaning metal articles with alkaline washing water, (2) rinsing said metal articles with deoxidized rinsing water, (3) producing dry vapor having no liquid phase from water in a boiler, (4) removing water from said metal articles by blowing said dry vapor evenly on said metal articles in a non-oxygen state so as to prevent formation of rust on the surface of the metal articles, and (5) drying said metal articles in a heated atmosphere.

2. The method according to claim 1, wherein said step of drying said metal articles comprises drying said metal articles in a vacuum reservoir having an interior in which said heated atmosphere is created.

3. The method according to claim 2, wherein a heated compressed inert gas is introduced into said vacuum reservoir.

4. A method of cleaning metal articles comprising the steps of:

(1) cleaning metal articles with alkaline washing water, (2) rinsing said metal articles with deoxidized rinsing water, (3) producing dry vapor having no liquid phase from water in a boiler, (4) removing water from said metal articles by blowing said dry vapor evenly on said metal articles in a non-oxygen state by a plurality of nozzles arranged equidistantly, vertically and circumferentially in a water-removing reservoir, said nozzles being arranged to jet said dry vapor evenly on said metal articles in said water-removing reservoir, thereby preventing the formation of rust on the surface of the metal articles, and (5) drying said metal articles in a heated atmosphere.

* * * * *